US005722853A

United States Patent [19]

Hwang

[11] Patent Number: 5,722,853

[45] Date of Patent: Mar. 3, 1998

[54] C-TYPE BULB SOCKET HAVING A DRAINING FEATURE

[76] Inventor: Min Shien Hwang, No. 2, Lane 65, Chen Kon Road, Hsinchu, Taiwan

[21] Appl. No.: 614,236

[22] Filed: Mar. 12, 1996

[51] Int. Cl.[6] ..... H01R 4/24; H01R 4/26; H01R 11/20

[52] U.S. Cl. ..... 439/419; 439/340

[58] Field of Search ..... 439/206, 340, 439/419, 205

[56] References Cited

U.S. PATENT DOCUMENTS

| | | | |
|---|---|---|---|
| 28,710 | 2/1860 | Finkelstein | 439/206 |
| 2,965,875 | 12/1960 | Danesi | 439/340 |
| 3,128,141 | 4/1964 | Krupp et al. | 439/419 |
| 3,143,697 | 8/1964 | Springer | 439/206 |
| 4,159,157 | 6/1979 | Koehler | 439/419 |
| 5,442,138 | 8/1995 | Ochi | 439/206 |
| 5,516,301 | 5/1996 | Kawakita | 439/206 |
| 5,552,348 | 9/1996 | Wu | 439/340 |
| 5,556,298 | 9/1996 | Huang | 439/419 |
| 5,569,044 | 10/1996 | Huang | 439/340 |

FOREIGN PATENT DOCUMENTS

| | | | |
|---|---|---|---|
| 0914818 | 1/1963 | United Kingdom | 439/419 |

*Primary Examiner*—Gary F. Paumen
*Assistant Examiner*—Katrina Davis
*Attorney, Agent, or Firm*—Morton J. Rosenberg; David I. Klein; Jun Y. Lee

[57] ABSTRACT

A C-type light bulb socket for outdoor use is provided having a plurality of apertures arranged on the socket shell draining water therefrom. Therefore, the potential danger of a short circuit caused by accumulated water is eliminated.

1 Claim, 3 Drawing Sheets

C-TYPE BULB SOCKET HAVING A DRAINING FEATURE

BACKGROUND OF THE INVENTION

Outdoor used C-type light bulb sockets are often subject to rain and so it is inevitable to have some water infiltrating into the socket. If sockets are arranged with light bulbs undermost, water will automatically flow out without serious bad effects. However, if sockets are set in an upright position with light bulbs uppermost, water might accumulate in it. Accumulated water staying inside the socket for a certain time may corrode the conductor plates of the socket, resulting in a short circuit. Consequently, the light bulb series fails due to an abnormal function of its component sockets.

In view of the above drawback of a prior art C-type light bulb socket, the primary object of the invention is to provide an improved light bulb socket for outdoor use that has apertures so arranged on the socket shell in the area around the conductor plates of the socket that water in the socket can be drained through these apertures, eliminating the drawback of accumulating water.

BRIEF DESCRIPTION OF THE ACCOMPANYING DRAWINGS

The structure and features of the present invention will now be described in detail with reference to the accompanying drawings, wherein.

DETAILED DESCRIPTION OF A PREFERRED EMBODIMENT

Figure 1:
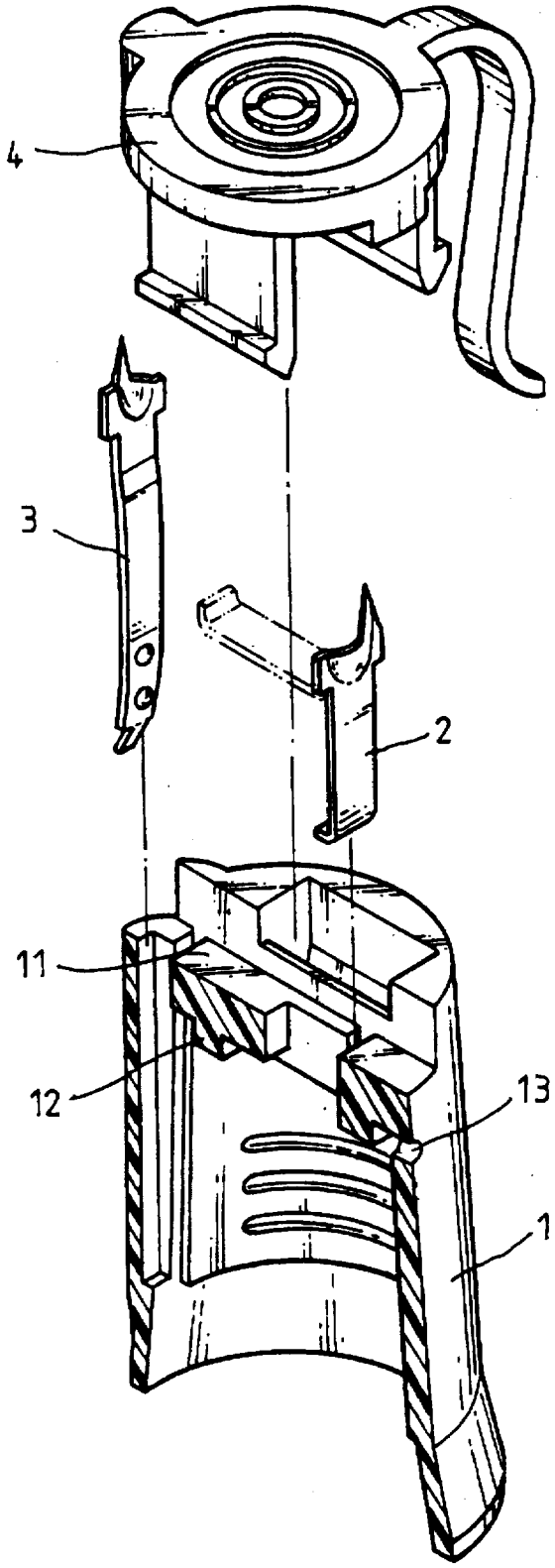
FIG. 1 is an exploded view of a light bulb socket according to the invention.
Figure 2:
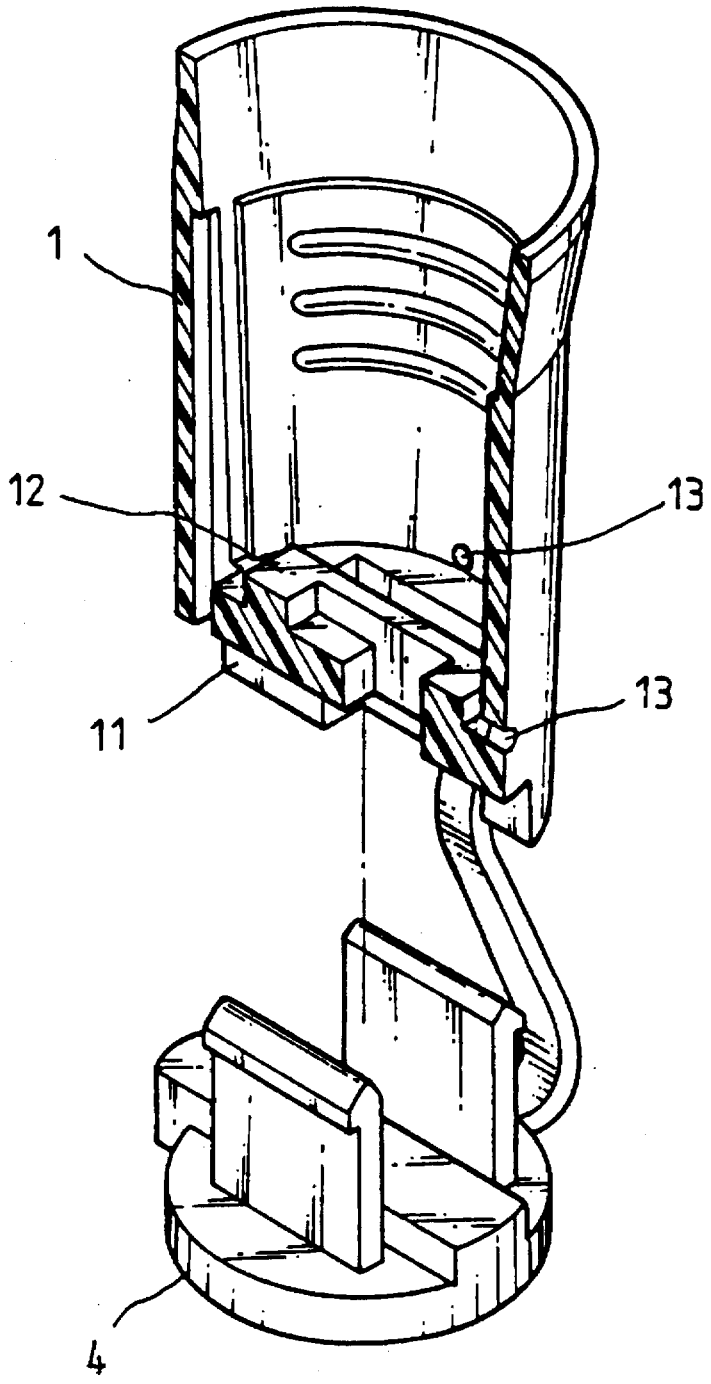
FIG. 2 is another exploded view inversely showing the light bulb socket of FIG. 1.
Figure 3:
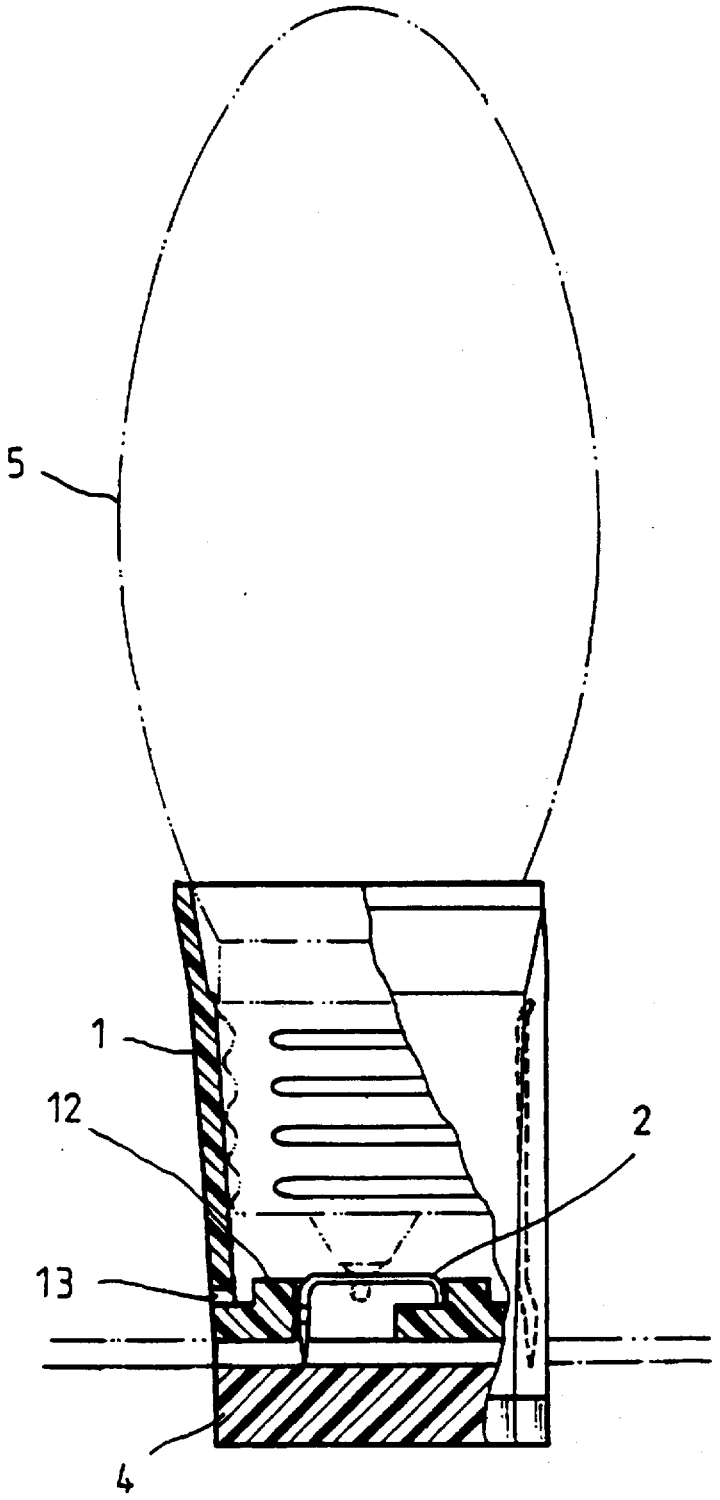
FIG. 3 is a cross sectional view of the socket of the invention.

Referring to the drawings, the light bulb socket of the invention includes a socket body (1) that comprises a retaining portion (11) provided on the top thereof for receiving two conductor plates (2) and (3), and a cap (4) attached to the body. The socket is characterized in that a protrusion (12) projects inwardly from the wall of the retaining portion

(11) and in that a plurality of apertures (13) are disposed on the side wall of the body (1) in a region around the retaining portion in a manner that the top surface of the protrusion (12) in comparison with the wall of the retaining portion (11) is higher than the position of those apertures (13) relative to same.

With such an arrangement, when the socket is used outdoors it can discharge water through those apertures (13) even if the socket is set with the light bulb (5) uppermost. Hence, water built up in the socket body will never exceed the top surface of the protrusion (12) and thus the damage caused by accumulated water can be avoided. On the other hand, when the socket is disposed with the light bulb (5) undermost any water penetrating into the socket will flow out of it through the gap between the periphery of the light bulb and the socket shell. As a result, water will not accumulate to cause a short circuit.

In summary, the invention makes use of a design of drainage in cooperation with a raised block to completely overcome the drawback of a prior art C-type light bulb socket. Obviously it can eliminate the potential danger of a short circuit caused by accumulated water.

What is claimed is:

1. An improved C-type light bulb socket, comprising:

a socket body having an open bore formed in one end thereof for receiving a light bulb therein and a retaining portion formed on an opposing end of said socket body, said socket body having a protrusion extending into said open bore from a wall of said retaining portion and a plurality of apertures formed through a peripheral wall of said socket body adjacent said retaining portion wall for draining water therethrough, said protrusion having an upper surface disposed a greater distance from said retaining portion wall than said plurality of apertures;

a pair of conductor plates extending through said retaining portion wall into said open bore for contacting respective connection portions of the light bulb, a centrally disposed one of said pair of conductor plates being located on said protrusion; and, a cap coupled to said socket body in overlying relationship with said retaining portion.

* * * * *